United States Patent [19]

Mohr et al.

[11] Patent Number: 4,705,057

[45] Date of Patent: Nov. 10, 1987

[54] CLEANING DEVICE FOR REGENERATIVE HEAT EXCHANGERS

[75] Inventors: Karl-Heinz Mohr, Ratingen; Manfred Tratz, Mülheim, both of Fed. Rep. of Germany

[73] Assignee: Balcke-Dürr Aktiengesellschaft, Ratingen, Fed. Rep. of Germany

[21] Appl. No.: 749,298

[22] Filed: Jun. 27, 1985

[30] Foreign Application Priority Data

Jun. 27, 1984 [DE] Fed. Rep. of Germany ..... 3423619

[51] Int. Cl.[4] ..... B08B 3/02

[52] U.S. Cl. ..... 134/180; 134/172; 165/5; 165/95; 239/227; 239/753; 118/323; 122/390

[58] Field of Search ..... 134/172, 175, 180, 181; 165/5, 95; 122/379, 390, 391, 392; 239/DIG. 13, 178, 187, 186, 227; 118/323

[56] References Cited

U.S. PATENT DOCUMENTS

| | | | |
|---|---|---|---|
| 987,450 | 3/1911 | Hibner et al. | 122/390 |
| 1,095,991 | 5/1914 | Bennett | 122/391 |
| 1,116,873 | 11/1914 | Cronin | 122/391 |
| 1,141,304 | 6/1915 | Bennett | 122/391 |
| 1,939,153 | 12/1933 | Villasuso | 165/5 |
| 2,236,635 | 4/1941 | Young et al. | 165/5 |
| 2,379,506 | 7/1945 | Yerrick et al. | 165/5 |
| 2,668,978 | 2/1954 | DeMart | 122/390 X |
| 2,812,923 | 11/1957 | Schoenherr et al. | 165/5 |
| 3,123,132 | 3/1964 | Hedgecock | 122/390 X |
| 3,183,961 | 5/1965 | Brandt | 165/5 |
| 3,233,661 | 2/1966 | Firgau et al. | 165/5 |
| 3,595,250 | 7/1971 | Hurst | 134/181 X |
| 4,058,158 | 11/1977 | Blom et al. | 165/5 X |
| 4,135,534 | 1/1979 | Autelli | 165/5 X |
| 4,296,780 | 10/1981 | Norbach | 165/5 |
| 4,428,417 | 1/1984 | Chesner | 165/5 |
| 4,528,820 | 7/1985 | Jonasson | 165/95 X |
| 4,542,785 | 9/1985 | Bagnall | 165/95 |

FOREIGN PATENT DOCUMENTS

| | | | |
|---|---|---|---|
| 1186972 | 9/1952 | France | 165/5 |
| 59-52199 | 3/1984 | Japan | 165/5 |
| 103708 | 1/1963 | Netherlands | 134/172 |
| 160588 | 3/1921 | United Kingdom | 122/390 |

*Primary Examiner*—Harvey C. Hornsby
*Assistant Examiner*—Frankie L. Stinson
*Attorney, Agent, or Firm*—Becker & Becker, Inc.

[57] ABSTRACT

A device for cleaning the heat-exchanging surface of a storage medium of a regenerative heat exchanger which has a rotatably driven hood. The device utilizes rinsing or cleaning fluid which is discharged from at least one spray nozzle essentially parallel to the planes of the heat-exchanging surfaces. The spray nozzles are movable relative to the storage medium. In order to provide a structurally simple, light-weight cleaning device which can be housed in a space-saving manner, the spray nozzle is disposed at the end of an at least two-part, telescopic nozzle holder which is mounted on the hood of the regenerative heat exchanger and is connected by a supply line with a transfer mechanism disposed in the center of rotation of the hood. The transfer mechanism includes a tubular piece which rotates with the hood, and a stationary housing which is sealed off relative to the tubular piece. The adjustment movement of the movable part of the nozzle holder can be derived from the rotational movement of the hood.

6 Claims, 4 Drawing Figures

CLEANING DEVICE FOR REGENERATIVE HEAT EXCHANGERS

BACKGROUND OF THE INVENTION

1. Field of the Invention

The present invention relates to a device for cleaning the heat-exchanging surfaces of a storage medium of a regenerative heat exchanger which has a rotatably driven hood; the device utilizes rinsing or cleaning fluid which is discharged from at least one spray nozzle essentially parallel to the planes of the heat-exchanging surfaces; the spray nozzles are movable relative to the storage means.

2. Description of the Prior Art

Cleaning devices for the storage media of regenerative heat exchangers are known not only for rotating storage media and fixed guide means, but also for fixed storage media and rotating hoods. As a rinsing or cleaning agent, compressed air or superheated steam, partially however, also water, are preferably used, to which anticorrosion inhibitors and wetting agents or solvents can be added.

An object of the present invention is to provide a cleaning device of the aforementioned general type which, in addition to having a simple structural design and a high operational reliability, has a low weight and requires little space, so that it does not produce a disruptive influence on the flow conditions within the regenerative heat exchanger.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
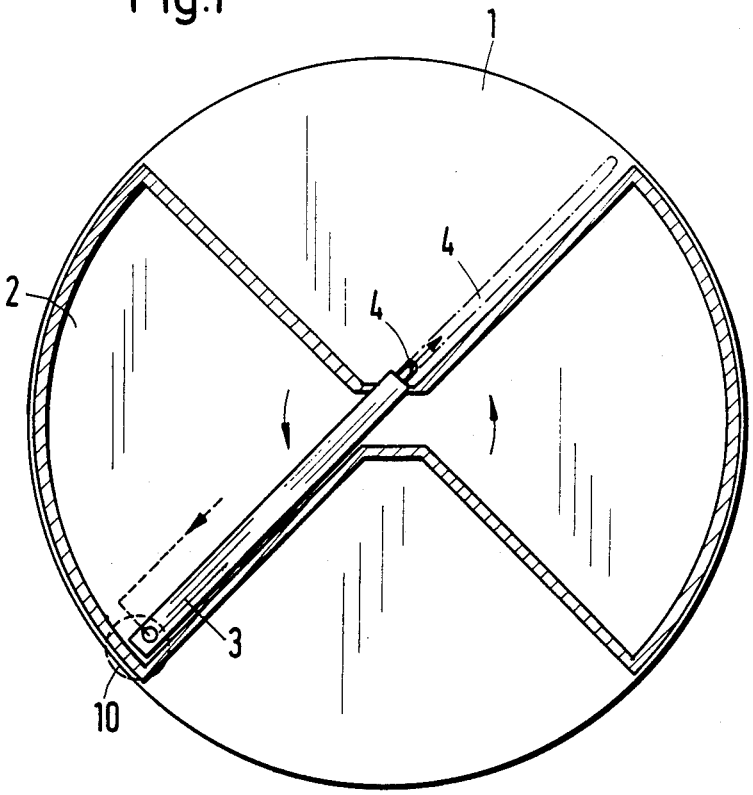
FIG. 1 is a schematic plan view of a regenerative heat exchanger having a rotatably driven hood to which is attached one inventive embodiment of a cleaning device.

The cleaning device of the present invention is characterized primarily in that the spray nozzle is disposed at the end of an at least two-part, telescopic nozzle holder which is mounted on the hood of the regenerative heat exchanger and is connected by means of a supply line with a transfer mechanism which is disposed in the center of rotation of the hood; this transfer mechanism includes a tubular piece which rotates with the hood, and a stationary housing which is sealed off relative to the tubular piece.

Pursuant to the proposal of the present invention, there is provided a particularly lightweight, space-saving, and simple cleaning device which essentially comprises only the telescopic nozzle holder, and a transfer mechansim through which the rinsing or cleaning fluid is supplied to the nozzle holder, which is disposed on the rotating hood. The nozzle holder, which is provided with at least one spray nozzle, is moved in the radial direction relative to the storage medium, so that as a result of the rotation of the hood, all of the heat-exchanging surfaces of the storage medium are successively cleaned or rinsed. The main part of the telescopic nozzle holder is disposed in that portion of the hood which covers the storage medium, so that merely the extensible end of the nozzle holder projects into the actual cross-sectional area of flow. However, the leading surface of this extensible part of the nozzle holder is small enough that no disruptions of the flow occur. Due to the movable arrangement of the spray nozzle, a very precise and efficient cleaning can be accomplished with the inventive device, so that there is achieved the further advantage that the rate of flow of the cleaning fluid can be reduced from that which was necessary with heretofore known devices Pursuant to one preferred embodiment of the present invention, the nozzle holder essentially comprises two parts, namely a base part which is attached to the hood, and a movable part which can move relative to the base part, with the back end of the base part being disposed on the outer periphery of the hood, and the front end being disposed in the vicinity of the center of rotation of the hood. In this way it is possible in a simple manner to move the spray nozzle, which is disposed on the front end of the movable part, over the entire radius of the stationary storage medium. Pursuant to a further feature of the present invention, the nozzle-containing movable part of the nozzle holder can be moved by a control mechanism or adjusting drive mechanism as a function of the size or circumference of that surface which is being sprayed with rinsing or cleaning fluid.

Although it is possible to dispose an adjusting drive mechanism for the a:ovable part of the nozzle holder on the rotating hood, it is proposed pursuant to a further development of the present invention to dispense with such a drive mechanism and to derive the adjustment movement for the movable part from the rotational movement of the hood. Thus, pursuant to a further specific embodiment of the present invention, the movable part may be connected with an endless, flexible pulling element, such as a cable, which is guided about two guide pulleys, with one of the guide pulleys being connected to a drive wheel which, during the rotational movement of the hood, is driven in stages by at least one stationary detent.

DESCRIPTION OF PREFERRED EMBODIMENTS

Referring now to the drawings in detail, the schematic plan view of a regenerative heat exchanger illustrated in FIG. 1 shows a stationary storage medium 1, which in the viewing direction is provided with heat-exchanging surfaces through or over which alternately flow hot flue gases and fresh air which is to be heated up. The alternation of these two flow media is achieved by a rotating hood or rotor 2. Such a hood 2 is disposed on each of the two ends of the cylindrical storage medium 1. The direction of rotation of the hood 2 is indicated by arrows in FIG. 1.

Disposed on the hood 2 is a cleaning device which thus rotates along with the hood. FIG. 1 shows a housing 3 of this cleaning device, as well as the front end of a nozzle holder 4 which can be telescoped, and which is provided with at least one spray nozzle. A rinsing or cleaning fluid exits this spray nozzle essentially parallel to the planes of the heat-exchanging surfaces of the storage medium 1. One embodiment of this cleaning device is illustrated in FIG. 2.

Figure 2:
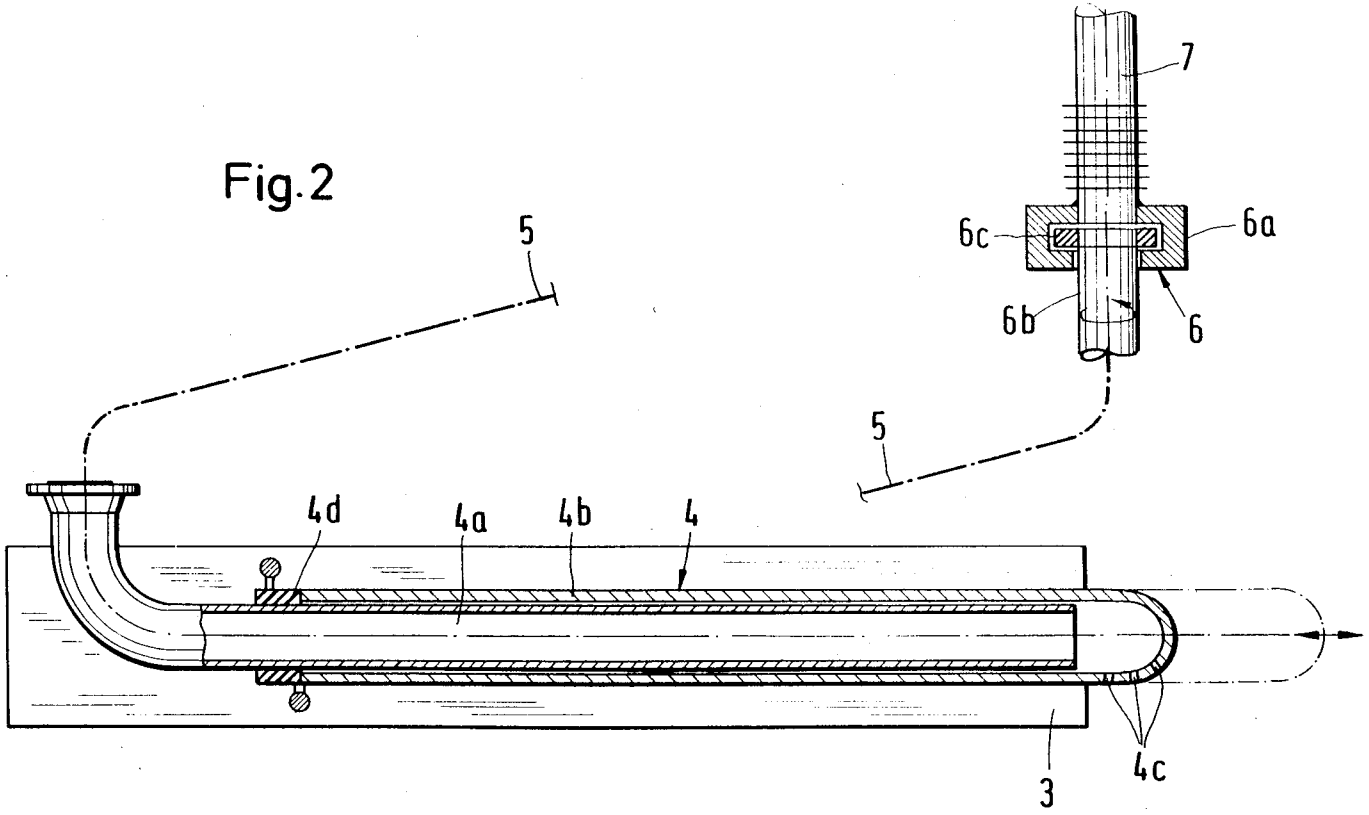
FIG. 2 is a view showing a perpendicular section taken through the telescopic nozzle holder and the transfer mechanism for the cleaning fluid.

Pursuant to the embodiment of FIG. 2, the nozzle holder 4 is embodied in two parts and is telesdopic. The nozzle holder 4 comprises a base part 4*a* which is mounted on the hood 2, and a movable part 4*b* the front end of which is provided with nozzle openings 4*c*. The front end of the tubular movable part 4*b* is closed off except for the nozzle openings 4*c*. The movable part 4*b* can be moved on the base part 4*a* in the longitudinal direction, as is indicated in FIG. 2 by the double-headed arrow and the dot-dash line. Disposed between the base part 4*a* and the movable part 4*b* are sealing means 4*d* which in every position of the movable part 4*b* relative to the base part 4*a* prevent cleaning fluid from exiting between the base part 4*a* and the movable part 4*b*.

The rinsing or cleaning fluid is supplied to the nozzle holder 4 via a supply line 5 (indicated schematically in FIG. 2), which with the aid of a transfer mechanism 6 communicates with a stationary line 7. In the embodiment illustrated in FIG. 2, a housing 6*a* is disposed at the end of this line 7, which leads from a pressure source for the cleaning fluid. This housing 6*a* is located in the center of rotation of the hood 2, and is concentric to the axis of rotation of the hood 2. Extending into the stationary housing 6*a* is the open end of a tubular piece 6*b*, which is provided with a sealing ring 6*c*, which in turn is disposed in the housing 6*a*. This tubular piece 6*b*, along with the sealing ring 6*c*, rotates with the hood 2 and communicates with the supply line 5, as shown in FIG. 2.

Figure 3:
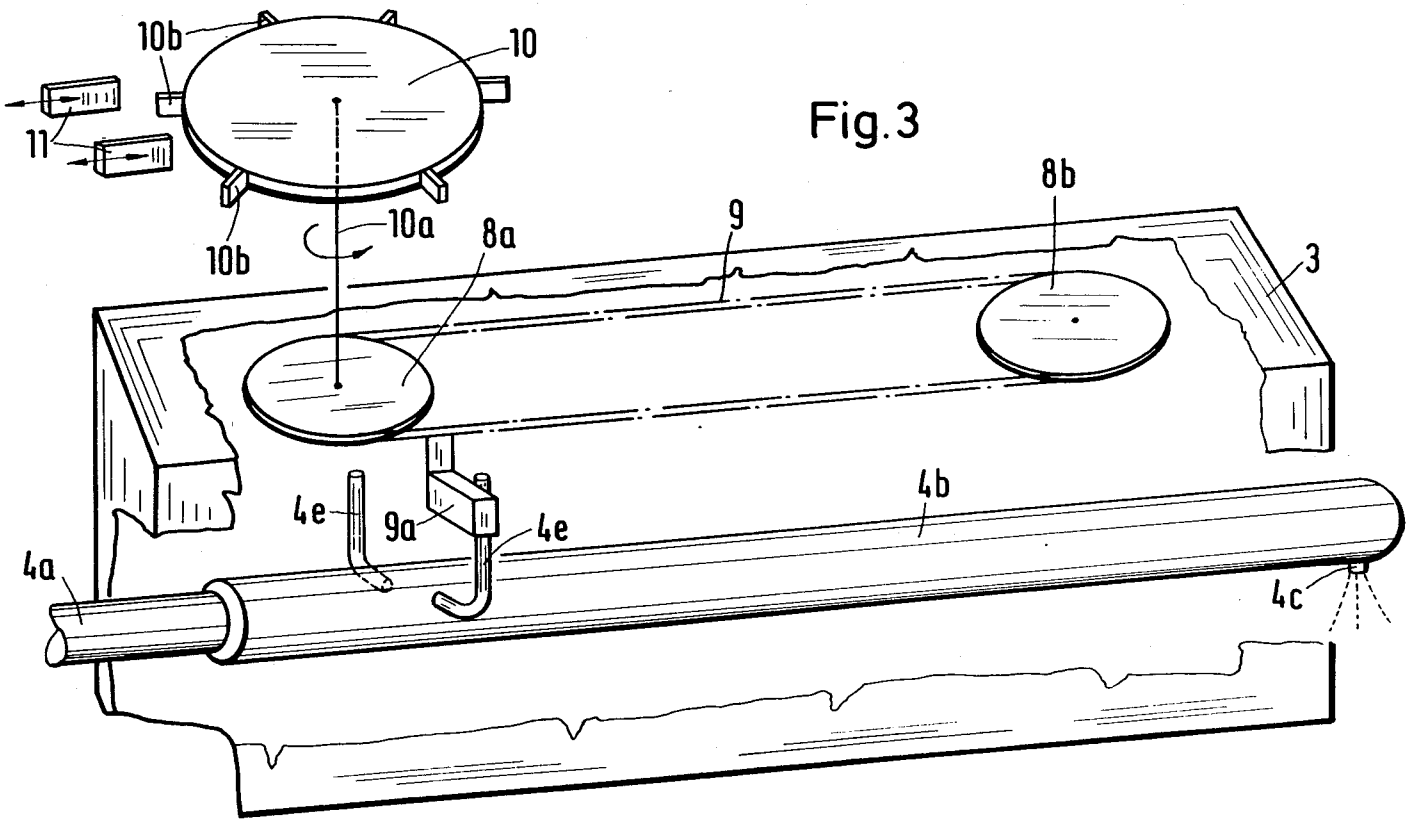
FIG. 3 is a view that shows the drive mechanism for the inventive cleaning device, which is accommodated in a housing.
Figure 4:
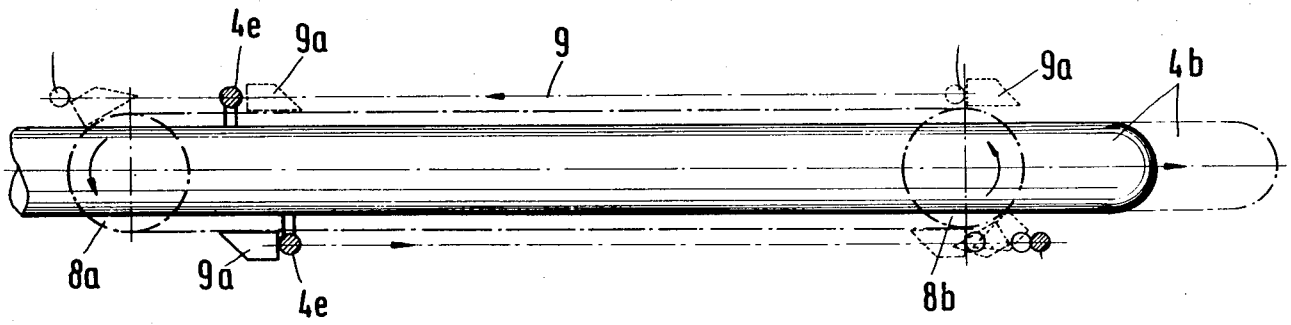
FIG. 4 is a plan view of the embodiment of FIG. 3, and diagrammatically illustrates the displacement movement of the movable part.

As indicated by dot-dash lines in FIGS. 1 and 2, the movable part 4*b* can move relative to the base part 4*a*. FIGS. 3 and 4 show one embodiment of the shifting mechanism required for this purpose.

In the illustrated embodiment, two guide pulleys 8*a* and 8*b* (FIG. 3) are rotatably mounted in the housing 3; an endless, flexible pulling element, for example a cable 9, extends over these guide pulleys 8*a*, 8*b*. A driver 9*a* is attached to this cable 9. Movement of cable 9 is effected with the aid of a drive wheel 10, the shaft 10*a* of which is fixedly connected with the guide pulley 8*a*.

The drive wheel 10 is shown in dashed lines in FIG. 1. This illustration shows that the drive wheel 10 extends slightly beyond the periphery of the hood 2. In this manner, the drive wheel 10, which is provided with projecting members 10*b*, can be rotated by fixed detents 11 when the hood 2, with the drive wheel 10, turn past these fixed detents 11. The rotation of the drive wheel 10, which is effected in stages, can be controlled by the arrangement and the number of the detents 11. As shown by the double-headed arrows in FIG. 3, it is possible to either advance the detents 11 into the range of movement of the projecting members 10*b* of the chain or drive wheel 10, or to retract these detents from this movement range.

The rotational movement of the cable 9, which is generated with the aid of the drive wheel 10, is utilized to displace the movable part 4*b* relative to the base part 4*a*. For this purpose, engagement or entrainment pins 4*e* are disposed on the movable part 4*b*. FIG. 4 shows that during a rotation of the driver 9*a*, the movable part 4*b* is first moved radially outwardly out of the telescoped or pushed-together position of the telescopic nozzle holder 4, in which position the nozzle openings 4*c* sweep over and spray the radially innermost parts of the storage medium 1, until the end position of the advancement movement is reached. Subsequently, after the driver 9*a* has moved around the guide pulley 8*b*, it starts its return. During this return of the driver 9*a*, the movable part 4*b* is taken along in the direction toward the end position of the return movement via the second engagement or entrainment pin 4*e*. For this purpose, the pins 4*e* are slightly offset relative to one another in the longitudinal direction of the movable part 4*b*; this can be seen particularly clearly in FIG. 4.

By an appropriate selection of the number of the fixed detents 11, and by controlling the introduction of these detents into the movement range of the projecting members 10*b* of the drive wheel 10, it is possible to either spray particularly endangered portions of the storage medium 1 especially thoroughly with rinsing or cleaning fluid, or to effect a uniform cleaning of the storage medium 1. In particular, this can be accomplished as a function of the circumference or size of the respective storage medium surface which is being sprayed with cleaning fluid.

The present invention is, of course, in no way restricted to the specific disclosure of the specification and drawings, but also encompasses any modifications within the scope of the appended claims.

What we claim is:

1. A device for cleaning heat-exchanging surfaces of a stationary storage medium of a regenerative heat exchanger which has a rotatably driven hood via a cleaning fluid which is discharged from at least one spray nozzle essentially parallel to the planes of said heat-exchanging surfaces; said at least one spray nozzle is movable relative to said storage medium; the improvement therewith which comprises:

an at least two-part, telscopic nozzle holder, which is mounted on said rotatably driven hood of said heat exchanger; said at least one spray nozzle being disposed at one end of said telescopic nozzle holder;

a supply line connected to said nozzle holder; and a transfer mechanism connected to a source of said cleaning fluid and to said supply line to furnish said cleaning fluid to said nozzle holder; said transfer mechanism being disposed in a location coinciding substantially with center of rotation of said hood, and includes a tubular piece, which rotates with said hood, and a stationary housing which is sealed off relative to said tubular piece and is connected to said source of oleaning fluid; said nozzle holder essentially comprising two parts, namely a base part which is attached to said hood, and a movable part which is movable relative to said base part and which movably projects relative to the stationary storage medium such that the cleaning fluid is discharged onto the heat-exchanging surfaces which are to be subjected to cleaning; an end of said base part remote from said at least one spray nozzle being disposed on the outer periphery of said hood, and an oppposite end of said base part being disposed in the vicinity of the center of rotation of said hood.

2. A cleaning device according to claim 1, in which said at least one spray nozzle is disposed on said movable part of said nozzle holder; and which includes an adjusting drive mechanism for moving said movable part as a function of the size of that heat-exchanging surface which at any given time is being sprayed with cleaning fluid; said at least one spray nozzle being disposed on said movable part of said nozzle holder, with the adjusting movement of said movable part being derived from the rotational movement of said hood.

3. A cleaning device according to claim 1, in which said at least one spray nozzle is disposed on said movable part of said nozzle holder, with an adjusting movement of said movable part being derived from a rotational movement of said hood;

an adjusting mechanism connected to said hood for effecting said adjusting movement of said movable part; said mechanism including two guide pulleys, a flexible pulling element which is guided about said pulleys and with which said movable part is connectable, and a drive wheel which is connected to one of said guide pulleys; and which includes at least one detent which is fixedly connected relative to said rotatable hood; during rotational movement of said hood, said drive wheel being driven in stages by means of said at least one detent.

4. A device for cleaning the heat-exchanging surfaces of a stationary storage medium of a regenerative heat exchanger which has a rotatably driven hood via a cleaning fluid which is discharged from at least one spray nozzle essentially parallel to the planes of said heat-exchanging surfaces; said at least one spray nozzle being movable relative to said storage medium; the improvement therewith which comprises:

an at least two-part, telescopic nozzle holder, which is mounted on said rotatably driven hood of said heat exchanger; said at least one spray nozzle being disposed at one end of said nozzle holder;

a supply line connected to said nozzle holder;

a transfer mechanism connected to a source of said cleaning fluid and to said supply line to furnish said cleaning fluid to said nozzle holder; said transfer mechanism being disposed in the center of rotation of said hood, and including a tubular piece, which rotates with said hood, and a stationary housing which is sealed off relative to said tubular piece and is connected to said source of cleaning fluid, said nozzle holder essentially comprising two parts, namely a base part which is attached to said hood, and a movable part which is movable relative to said base part; an end of said base part remote from said at least one spray nozzle being disposed on the outer periphery of said hood, and an opposite end of said base part being disposed in the vicinity of the center of rotation of said hood, said at least one spray nozzle being disposed on said movable part of said nozzle holder, with an adjusting movement of said movable part being derived from a rotational movement of said hood;

an adjusting mechanism connected to said hood for effecting said adjusting movement of said movable part; said mechanism including two guide pulleys, a flexible pulling element which is guided about said pulleys and with which said movable part is connectable, and a drive wheel which is connected to one of said guide pulleys; and which includes at least one detent which is fixedly connected relative to said rotatable hood; during rotational movement of said hood, said drive wheel being driven in stages by means of said at least one detent.

5. A cleaning device according to claim 4, in which said movable part of said nozzle holder is provided with entrainment means; and in which said pulling element is a cable which is provided with driver means for engaging said entrainment means to thus impart said adjusting movement to said movable part.

6. A cleaning device according to claim 4, in which said at least one spray nozzle is disposed on said movable part of said nozzle holder; and which includes an adjusting drive mechanism for moving said movable part as a function of the size of that heat-exchanging surface which at any givern time is being sprayed with cleaning fluid.

* * * * *